US010428654B2

(12) United States Patent
Feng et al.

(10) Patent No.: US 10,428,654 B2
(45) Date of Patent: Oct. 1, 2019

(54) CUTTER HEAD FOR MICROWAVE PRESPLITTING TYPE HARD-ROCK TUNNEL BORING MACHINE

(71) Applicant: NORTHEASTERN UNIVERSITY, Shenyang, Liaoning (CN)

(72) Inventors: Xia Ting Feng, Liaoning (CN); Gao Ming Lu, Liaoning (CN); Yuan Hui Li, Liaoning (CN); Xi Wei Zhang, Liaoning (CN)

(73) Assignee: NORTHEASTERN UNIVERSITY, Shenyang, Liaoning Province (CN)

( * ) Notice: Subject to any disclaimer, the term of this patent is extended or adjusted under 35 U.S.C. 154(b) by 0 days.

(21) Appl. No.: 15/764,668

(22) PCT Filed: Jun. 9, 2017

(86) PCT No.: PCT/CN2017/087699
§ 371 (c)(1),
(2) Date: Mar. 29, 2018

(87) PCT Pub. No.: WO2018/214180
PCT Pub. Date: Nov. 29, 2018

(65) Prior Publication Data

US 2019/0040741 A1 Feb. 7, 2019

(30) Foreign Application Priority Data

May 26, 2017 (CN) ..... 2017 1 0383216

(51) Int. Cl.

| | |
|---|---|
| ***E21D 9/10*** | (2006.01) |
| ***E21C 37/16*** | (2006.01) |
| ***E21B 7/15*** | (2006.01) |

(52) U.S. Cl.
CPC ..... *E21D 9/1006* (2013.01); *E21B 7/15* (2013.01); *E21C 37/16* (2013.01); *E21D 9/1073* (2013.01)

(58) Field of Classification Search
CPC ..... E21D 9/1073; E21D 9/1006; E21C 37/16; E21B 7/14; E21B 7/15
See application file for complete search history.

(56) References Cited

U.S. PATENT DOCUMENTS 3,881,777 A * 5/1975 Altseimer ..... E21D 9/04 175/11
4,618,298 A * 10/1986 Takamiya ..... E21D 9/0607 405/138

(Continued)

FOREIGN PATENT DOCUMENTS

CN 203961781 U 11/2014
CN 104563883 A 4/2015

(Continued)

OTHER PUBLICATIONS

English language machine translation of Fries DE-2234807-A1, published Jan. 24, 1974 (8 pages) (Year: 1974).*

*Primary Examiner* — Janine M Kreck
*Assistant Examiner* — Michael A Goodwin
(74) *Attorney, Agent, or Firm* — Muncy, Geissler, Olds & Lowe, P.C.

(57) ABSTRACT

A cutter head has a front surface formed with several transmitting ports, a protection plate mounted at an external-end hole of each port, several microwave generating mechanisms distributed in two manners: first, the generating mechanisms are uniformly arranged in the cutter head; second, the microwave generating mechanisms in the same number as hobbing cutters. Each generating mechanism includes a microwave source, a magnetron, a rectangular waveguide, a circulator and a microwave focus radiator, (Continued)

wherein the microwave source is connected with the magnetron, the magnetron is connected with one end of the waveguide, the other end of the waveguide is connected with a first port of the circulator, a second port of the circulator is connected with the microwave focus radiator, and a water load is connected to a third port of the circulator. The focus radiator includes a standard waveguide section, an impedance matching section and a compressed radiation section.

8 Claims, 3 Drawing Sheets

(56) References Cited

U.S. PATENT DOCUMENTS

| | | | | |
|---|---|---|---|---|
| 6,114,676 | A * | 9/2000 | Jerby | H05B 6/70 219/384 |
| 2009/0321132 | A1* | 12/2009 | Ouellet | E21B 7/15 175/11 |
| 2012/0230471 | A1* | 9/2012 | Chen | H05H 7/02 378/105 |
| 2014/0231398 | A1* | 8/2014 | Land | B23K 26/0093 219/121.72 |
| 2015/0060052 | A1 | 3/2015 | Caryotakis | |

FOREIGN PATENT DOCUMENTS

| | | | | |
|---|---|---|---|---|
| CN | 104929513 | A | 9/2015 | |
| CN | 105350976 | A | 2/2016 | |
| DE | 2234807 | A1 * | 1/1974 | E21C 37/16 |
| DE | 102007060409 | A1 | 6/2009 | |

* cited by examiner

CUTTER HEAD FOR MICROWAVE PRESPLITTING TYPE HARD-ROCK TUNNEL BORING MACHINE

BACKGROUND OF THE INVENTION

1. Field of the Invention

The present invention belongs to the technical fields of geotechnical engineering and tunnel engineering, and particularly relates to a cutter head for a microwave presplitting type hard-rock tunnel boring machine.

2. The Prior Arts

As a main manner of tunnel construction, the hard-rock tunnel boring machine has the advantages of being high in boring speed, environmental-friendly, high in comprehensive benefits, and the like, and can realize construction of long tunnels with complex geography, land features and buried depth, which is difficult to realize by a conventional bore hold-blasting method.

In current stage, adoption of the hard-rock tunnel boring machine for long-tunnel construction is a mature mechanical rock breaking method. Based on the conventional mechanical rock breaking method, relevant technicians have also proposed the idea of microwave-assisted mechanical rock breaking. Because different mineral components in rock have different absorption characteristics toward microwaves and internal stress caused by different thermal expansions of all minerals can cause intercrystalline fractures and transcrystalline fractures in the rock, damages and microcracks are produced in the rock, and the uniaxial compressive strength, tensile strength, point load intensity and the like of the rock can be reduced. At the moment, the problem that rock breaking cutters are easy to wear can be solved by using mechanical rock breaking, and further, the advantages of mechanical rock breaking can be fully exerted.

For example, Chinese patent publication No. 104563883A provides a microwave-assisted hole drilling and rock breaking scheme. In the scheme, a rock breaking assisted microwave generator is embedded inside a cutter wing of a bit inserting body, the microwave transmission route of the rock breaking assisted microwave generator is as follows: a magnetron, a rectangular waveguide pipe, a coaxial waveguide pipe and a needle electrode sequentially, and microwaves are finally transmitted by the needle electrode. In order to enable the rock to fully absorb microwave energy, the power density during microwave transmission is crucial, and also guarantees that the rock can absorb as much as microwave energy in unit area. However, the rock breaking assisted microwave generator disclosed by the patent application is not provided with a component for microwave focusing at all, namely that microwaves emitted by the magnetron will be transmitted out at a constant power density from the needle electrode. The rated power of the magnetron must be increased so as to fully realize rock surface splitting. However, the size range of a PDC bit is fixed and the cutter wing size of the bit inserting body is even smaller. Based on a current technical level, a high-power magnetron cannot be mounted in a small-size PDC bit cutter wing due to size restriction. If a low-power magnetron is selected to conform to the mounting condition, the power density of microwave cannot meet rock surface splitting needs, and further the effect of assisted hole drilling and rock breaking cannot be exerted. That is, Chinese patent publication No. 104563883A cannot be put into practical application in a short time.

During tunnel construction, a cutter head for a hard-rock tunnel boring machine is completely different from the PDC bit. The size of the cutter head for the hard-rock tunnel boring machine is much greater, so that the use of high-power magnetron becomes possible. However, how to enable microwave generating equipment to be arranged in the cutter head for the hard-rock tunnel boring machine and which arrangement mode can meet microwave assisted rock presplitting effect during tunnel boring are still technical gaps at present. In addition, in terms of the current technical level, only microwaves with constant power density can be adopted for rock surface splitting. Because the power of the magnetron cannot be increased without limitation, the rock surface splitting effect difficultly reaches the desired requirement. Therefore, microwaves with constant power density must be focused to increase power density during microwave transmission, so that industrial application can be met as quickly as possible. At present, although a universal pyramidal horn radiating antenna can realize focus transmission of microwave to a certain extent, the pyramidal horn radiating antenna is large in size, low in aperture efficiency, low in absorption efficiency for rock and high in energy consumption, and the rock surface splitting effect difficultly meets the requirement.

Thus, in order to meet industrial application requirements as quickly as possible, a cutter head for a hard-rock tunnel boring machine with microwave assisted rock breaking capability needs to be designed urgently to fully exert the advantages of the hard-rock tunnel boring machine, effectively improve the tunnel construction efficiency and further reduce the tunnel construction cost.

SUMMARY OF THE INVENTION

In accordance with the problems existing in the prior art, the present invention provides a cutter head for a microwave presplitting type hard-rock tunnel boring machine which effectively meets industrial application requirements and can fully exert the advantages of the hard-rock tunnel boring machine, effectively improve the tunnel construction efficiency and further reduce the tunnel construction cost.

In order to realize the purpose, the cutter head for the microwave presplitting hard-rock tunnel boring machine adopts the technical scheme that the cutter head defines an outer circumference near an outer periphery thereof and an inner circumference near an axis thereof, a diameter of the outer circumference is greater than that of the inner circumference, a plurality of microwave transmitting ports are formed in a front surface of the cutter head, a wave-transparent protection plate is mounted at external-end holes of the microwave transmitting ports, internal-end holes of the microwave transmitting ports communicate with the cutter head, a plurality of microwave generating mechanisms are arranged in the cutter head, and the microwave generating mechanisms are the same in number as the microwave transmitting ports and are in one-to-one correspondence.

The microwave generating mechanisms are distributed in the cutter head in one of two distribution manners, wherein the first distribution manner is as follows: the microwave generating mechanisms are uniformly arranged in the cutter head; the second distribution manner is as follows: the microwave generating mechanisms are the same in number as hobbing cutters on the cutter head and are arranged in one-to-one correspondence, one microwave generating mechanism and the microwave transmitting port corresponding to the microwave generating mechanism are arranged beside each hobbing cutter.

When the microwave generating mechanisms are distributed in the cutter head in the first distribution manner, all the microwave generating mechanisms have the same microwave radiation power, and the number of the microwave generating mechanisms on the outer circumference and inner circumference of the cutter head is calculated according to the following formula:

$$\frac{Q_R}{L_R} = \frac{Q_r}{L_r}$$

$$\frac{N_R PT}{\theta_R} = \frac{N_r PT}{\theta_r}$$

$$\frac{N_R}{N_r} = \frac{R}{r}$$

wherein, $Q_R$ is a total microwave energy radiated by the microwave generating mechanisms on the outer circumference when the cutter head rotates by an angle of θ, $Q_r$ is a total microwave energy radiated by the microwave generating mechanisms on the inner circumference when the cutter head rotates by the angle of θ, $L_R$ is an arc length rotated by the microwave generating mechanisms on the outer circumference when the cutter head rotates by the angle of θ, $L_r$ is an arc length rotated by the microwave generating mechanisms on the inner circumference when the cutter head rotates by the angle of θ, P is a microwave radiation power of each of the microwave generating mechanisms, T is a microwave radiation time of each of the microwave generating mechanisms, R is a radius of the outer circumference of the cutter head, r is a radius of the inner circumference of the cutter head, $N_R$ is the number of the microwave generating mechanisms on the outer circumference of the cutter head, Nr is the number of the microwave generating mechanisms on the inner circumference of the cutter head, and θ is a rotation angle of the cutter head.

When the microwave generating mechanisms are distributed in the cutter head in the second mode, all the microwave generating mechanisms have different microwave radiation power, the total microwave energy radiated by the microwave generating mechanisms on the outer circumference of the cutter head is the same as that radiated by the microwave generating mechanisms on the inner circumference of the cutter head, and the microwave radiation power of the microwave generating mechanisms on the outer circumference and the inner circumference of the cutter head is calculated according to the following formula:

$$\frac{P_R T}{\theta_R} = \frac{P_r T}{\theta_r}$$

$$\frac{P_R}{P_r} = \frac{R}{r}$$

wherein $P_R$ is a total microwave radiation power of the microwave generating mechanisms on the outer circumference of the cutter head, $P_r$ is a total microwave radiation power of the microwave generating mechanisms on the inner circumference of the cutter head, T is a microwave radiation time of each of the microwave generating mechanisms, R is a radius of the outer circumference of the cutter head, r is a radius of the inner circumference of the cutter head, and θ is a rotation angle of the cutter head.

Each microwave generating mechanism comprises a microwave source, a magnetron, a rectangular waveguide, a circulator and a microwave focus radiator, wherein the microwave source is connected with the magnetron, the magnetron is connected with one end of the rectangular waveguide, the other end of the rectangular waveguide is connected with a first port of the circulator, a second port of the circulator is connected with the microwave focus radiator, and a water load is connected to a third port of the circulator.

The microwave focus radiator comprises a standard waveguide section, an impedance matching section and a compressed radiation section, wherein the standard waveguide section is used for receiving microwaves emitted by the microwave source, the standard waveguide section is connected with the impedance matching section, and the impedance matching section is connected with the compressed radiation section; the impedance matching section is used for forming impedance matching between the standard waveguide section and the compressed radiation section; and the compressed radiation section is used for forming and radiating microwaves with high power density, and the compressed radiation section is embedded in the microwave transmitting port.

The compressed radiation section has a constant-section rectangular metal cavity, and the transverse broadside dimension of the constant-section rectangular metal cavity is matched with a wave length of microwaves emitted by the microwave source.

The impedance matching section has a variable-section rectangular metal cavity, and a transverse broadside dimension of the variable-section rectangular metal cavity is matched with a wave length of microwaves emitted by the microwave source; and a longitudinal narrow-side dimension of the variable-section rectangular metal cavity of the impedance matching section forms a linear transition from large to small, a large-dimension end of the longitudinal narrow-side is connected with the standard waveguide section, and a small-dimension end of the longitudinal narrow-side is connected with the compressed radiation section.

The compressed radiation section has a constant-section rectangular metal cavity, and a transverse broadside dimension of the constant-section rectangular metal cavity is matched with a wave length of microwaves emitted by the microwave source.

The microwave source preferably has a frequency of 2.45 GHz and a power of 10 kW or below, and a transverse broadside dimension of the rectangular waveguide, a transverse broadside dimension of the standard waveguide section, a transverse broadside dimension of the impedance matching section and a transverse broadside dimension of the compressed radiation section are preferably 109 mm or 86 mm.

The cutter head for the microwave presplitting type hard-rock tunnel boring machine has the beneficial effects of effectively meeting industrial application requirements, being capable of fully exerting the advantages of the hard-rock tunnel boring machine, effectively improving the tunnel construction efficiency and further reducing the tunnel construction cost.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

The present invention will now be further described in details in connection with the accompanying drawings and embodiments.

Figure 1A:
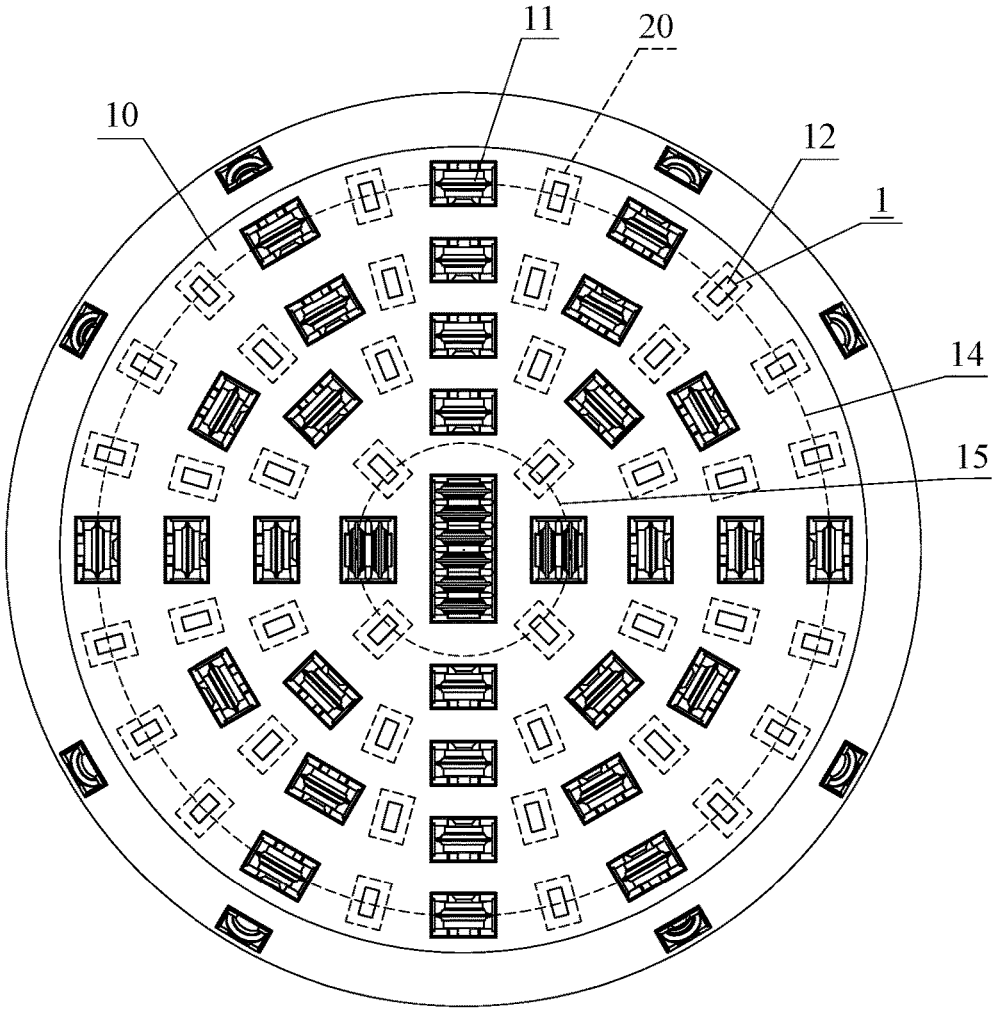
FIG. 1A is a front view of microwave generating mechanisms distributed in the cutter head in a first distribution manner according to a cutter head for a microwave presplitting type hard-rock tunnel boring machine.
Figure 1B:
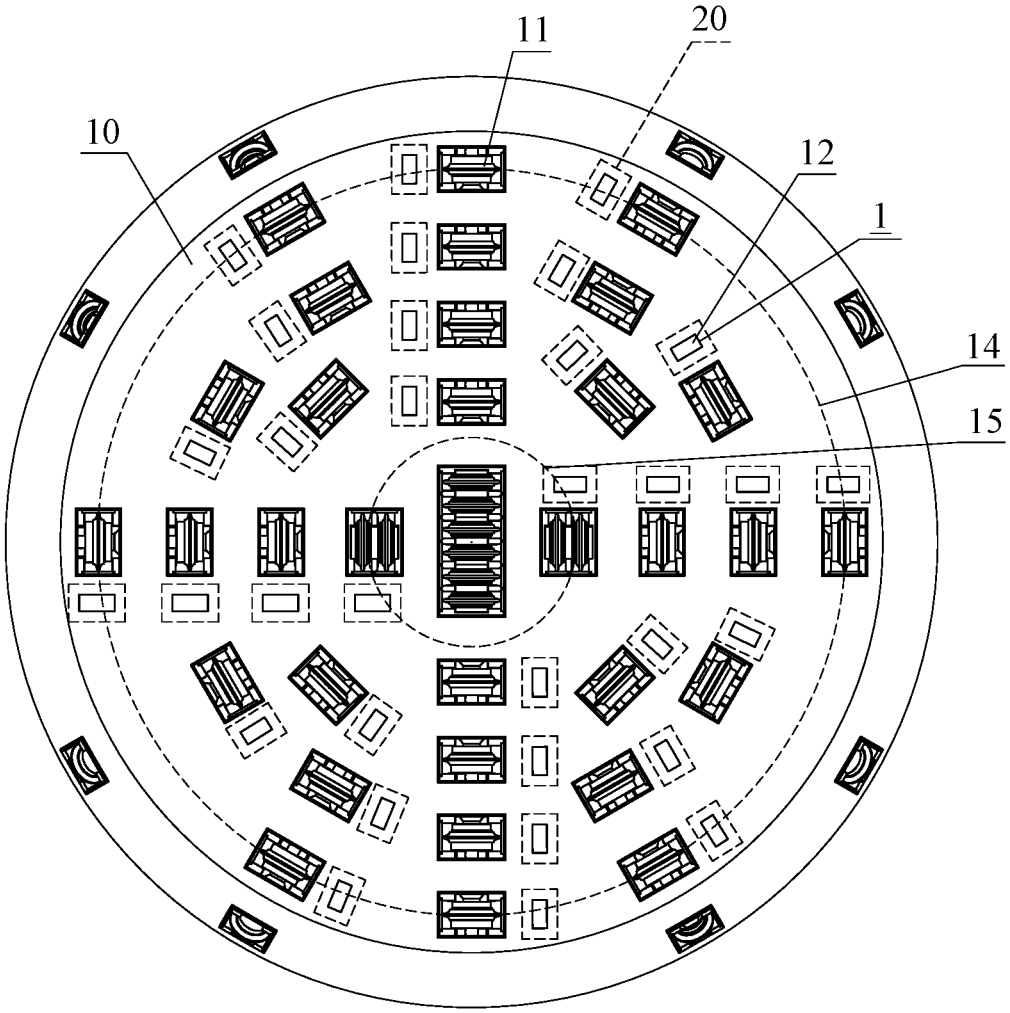
FIG. 1B is a front view of microwave generating mechanisms distributed in the cutter head in a second distribution manner according to a cutter head for a microwave presplitting type hard-rock tunnel boring machine.
Figure 2:
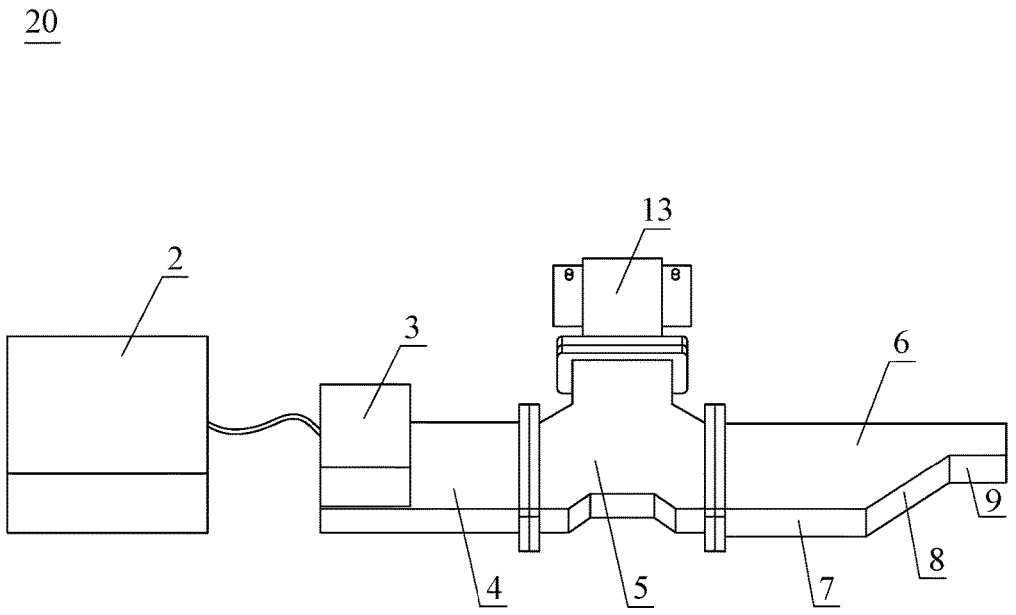
FIG. 2 is a structure diagram of a microwave generating mechanism, wherein 1 indicates microwave transmitting port, 2 indicates microwave source, 3 indicates magnetron, 4 indicates rectangular waveguide, 5 indicates circulator, 6 indicates microwave focus radiator, 7 indicates standard waveguide section, 8 indicates impedance matching section, 9 indicates compressed radiation section, 10 indicates cutter head, 11 indicates hobbing cutter, 12 indicates wave-transparent protection plate, 13 indicates water load.

As shown in FIG. 1A, FIG. 1B and FIG. 2, according to the cutter head for the microwave presplitting type hard-rock tunnel boring machine, the cutter head 10 defines an outer circumference 14 near an outer periphery thereof and an inner circumference 15 near an axis thereof, a diameter of the outer circumference 14 is greater than that of the inner circumference 15, a plurality of microwave transmitting ports 1 are formed in a front surface of the cutter head 10, a wave-transparent protection plate 12 is mounted at external-end holes of the microwave transmitting ports 1, internal-end holes of the microwave transmitting ports 1 communicate with the cutter head, a plurality of microwave generating mechanisms 20 are arranged in the cutter head, and the microwave generating mechanisms 20 are the same in number as the microwave transmitting ports 1 and are in one-to-one correspondence; The wave-transparent protection plate 12 can be made of TEFLON, can guarantee that microwaves transmit well, and can also prevent rock fragment from entering the microwave transmitting port 1.

The microwave generating mechanisms 20 are distributed in the cutter head 10 in one of two distribution manners, wherein as best shown in FIG. 1A, the first distribution manner is as follows: the microwave generating mechanisms 20 are uniformly arranged in the cutter head 10; as best shown in FIG. 1B, the second distribution manner is as follows: the microwave generating mechanisms 20 are the same in number as hobbing cutters 11 on the cutter head 10 and are arranged in one-to-one correspondence, one microwave generating mechanism and the microwave transmitting port 1 corresponding to the microwave generating mechanism are arranged beside each hobbing cutter 11.

As best shown in FIG. 1A, when the microwave generating mechanisms 20 are distributed in the cutter head 10 in the first distribution manner, all the microwave generating mechanisms 20 have the same microwave radiation power, and the number of the microwave generating mechanisms 20 on the outer circumference 14 and inner circumference 15 of the cutter head 10 is calculated according to the following formula:

$$\frac{Q_R}{L_R} = \frac{Q_r}{L_r} \frac{N_R PT}{\theta_R} = \frac{N_r PT}{\theta_r}$$

$$\frac{N_R}{N_r} = \frac{R}{r}$$

wherein $Q_R$ is a total microwave energy radiated by the microwave generating mechanisms 20 on the outer circumference 14 when the cutter head 10 rotates by an angle of θ, $Q_r$ is a total microwave energy radiated by the microwave generating mechanisms 20 on the inner circumference 15 when the cutter head 10 rotates by the angle of θ, $L_R$ is an arc length that the microwave generating mechanisms 20 rotate on the outer circumference 14 when the cutter head 10 rotates by the angle of θ, $L_r$ is an arc length that the microwave generating mechanisms 20 rotate on the inner circumference 15 when the cutter head 10 rotates by the angle of θ, P is a microwave radiation power of each of the microwave generating mechanisms 20, T is a microwave radiation time of each of the microwave generating mechanisms 20, R is a radius of the outer circumference 14 of the cutter head 10, r is a radius of the inner circumference 15 of the cutter head 10, $N_R$ is the number of the microwave generating mechanisms 20 on the outer circumference 14 of the cutter head 10, $N_r$ is the number of the microwave generating mechanisms 20 on the inner circumference 15 of the cutter head 10, and 0 is the rotation angle of the cutter head 10.

As best shown in FIG. 1B, when the microwave generating mechanisms 20 are distributed in the cutter head 10 in the second distribution manner, all the microwave generating mechanisms 20 have different microwave radiation power, total microwave energy radiated by the microwave generating mechanisms 20 on the outer circumference 14 of the cutter head 10 is the same as that radiated by the microwave generating mechanisms 20 on the inner circumference 15 of the cutter head 10, and the microwave radiation power of the microwave generating mechanisms 20 on the outer circumference 14 and the inner circumference 15 of the cutter head 10 is calculated according to the following formula:

$$\frac{P_R T}{\theta_R} = \frac{P_r T}{\theta_r}$$

$$\frac{P_R}{P_r} = \frac{R}{r}$$

wherein $P_R$ is a total microwave radiation power of the microwave generating mechanisms 20 on the outer circumference 14 of the cutter head 10, $P_r$ is a total microwave radiation power of the microwave generating mechanisms 20 on the inner circumference 15 of the cutter head 10, T is a microwave radiation time of each of the microwave generating mechanisms 20, R is a radius of the outer circumference 14 of the cutter head 10, r is a radius of the inner circumference 15 of the cutter head 10, and θ is a rotation angle of the cutter head 10.

Each microwave generating mechanism 20 comprises a microwave source 2, a magnetron 3, a rectangular waveguide 4, a circulator 5 and a microwave focus radiator 6, wherein the microwave source 2 is connected with the magnetron 3, the magnetron 3 is connected with one end of the rectangular waveguide 4, the other end of the rectangular waveguide 4 is connected with the first port of the circulator 5, the second port of the circulator 5 is connected with the microwave focus radiator 6, and a water load is connected to the third port of the circulator 5. According to actual mounting requirements, if necessary, a 90-degree rectangular waveguide adaptor elbow can also be additionally mounted between the second port of the circulator 5 and the microwave focus radiator 6, so that the microwave radiation direction is reversed by 90 degrees.

The microwave focus radiator 6 comprises a standard waveguide section 7, an impedance matching section 8 and a compressed radiation section 9, wherein the standard waveguide section 7 is used for receiving microwaves emitted by the microwave source 2, the standard waveguide section 7 is connected with the impedance matching section 8, and the impedance matching section 8 is connected with the compressed radiation section 9; the impedance matching section 8 is used for forming impedance matching between the standard waveguide section 7 and the compressed radiation section 9; and the compressed radiation section 9 is used for forming and radiating microwaves with high power density, and the compressed radiation section 9 is embedded in the microwave transmitting port 1.

The standard waveguide section 7 has a constant-section rectangular metal cavity, and a transverse broadside dimension of the constant-section rectangular metal cavity is matched with a wave length of microwaves emitted by the microwave source 2.

The impedance matching section 8 has a variable-section rectangular metal cavity, and a transverse broadside dimension of the variable-section rectangular metal cavity is matched with a wave length of microwave emitted by the microwave source; and a longitudinal narrow-side dimension of the variable-section rectangular metal cavity of the impedance matching section 8 forms a linear transition from large to small, a large-dimension end of the longitudinal narrow-side is connected with the standard waveguide section 7, and a small-dimension end of the longitudinal narrow-side is connected with the compressed radiation section 9.

The compressed radiation section 9 has a constant-section rectangular metal cavity, and a transverse broadside dimension of the constant-section rectangular metal cavity is matched with a wave length of microwaves emitted by the microwave source.

The microwave source preferably has a frequency of 2.45 GHz and a power of 10 kW or below, and a transverse broadside dimension of the rectangular waveguide, a transverse broadside dimension of the standard waveguide section, a transverse broadside dimension of the impedance matching section and a transverse broadside dimension of the compressed radiation section are preferably 109 mm or 86 mm. The corresponding national standard model is BJ22 or BJ26 (and the corresponding U.S. EIA standard model is WR430 or WR340).

One use process of the cutter head for the microwave presplitting type hard-rock tunnel boring machine is described hereinafter in combination with the drawings:

It is recommended to adopt an integrated control mode on all microwave generating mechanisms 20 in the cutter head 10, so that the microwave radiating power, microwave radiating time and the start-stop state of any microwave generating mechanism 20 can be controlled separately. Not only can the mounting space in the cutter head 10 be saved, but also operation and inspection are convenient.

After the cutter head is mounted on the hard-rock tunnel boring machine, the matching mode between microwave radiation and cutter cutting is determined according to the actual absorption capability of field engineering rock mass toward microwaves before boring construction.

If the field engineering rock mass has strong absorption capability toward microwaves, microwave radiation and cutter cutting can be performed at the same time, namely, the cutter head 10 rotates to make the hobbing cutter 11 cut the rock mass, and besides, the microwave generating mechanisms 20 are started to radiate microwaves so as to realize the purpose of splitting while boring.

If the field engineering rock mass has weak absorption capability toward microwaves, microwave radiation and cutter cutting can be performed alternately, namely that the microwave generating mechanisms 20 are started firstly to radiate microwaves toward the rock, and after the rock reaches a certain splitting effect, the cutter head 10 rotates to make the hobbing cutter 11 cut the rock mass, and it is not necessary to stop microwave radiation during boring. After the split rock is cut off, advance can be suspended. When the following rock also reaches a certain splitting effect, advance can be restored. In such a manner, advance can be repeated.

The working principle of the microwave generating mechanisms 20 is as follows: the microwave source 2 converts AC electric energy into DC electric energy, the magnetron 3 converts the DC electric energy into microwave energy, the produced microwaves firstly enter the circulator 5 through the rectangular waveguide 4, are transmitted in the one-way circular manner in the circulator 5 and enter the standard waveguide section 7 of the microwave focus radiator 6 through the second port of the circulator 5, so that the microwaves are input into the variable-section rectangular metal cavity of the impedance matching section 8 through the standard waveguide section 7, the microwaves gradually realize impedance matching and are focused between the standard waveguide section 7 and the compressed radiation section 9, the microwave power density is also increased gradually until the microwaves are transmitted to the compressed radiation section 9, the microwave power density reaches the maximum value in the compressed radiation section 9, and finally the microwaves are directionally radiated through the compressed radiation section 9. Firstly, the microwaves penetrate through the wave-transparent protection plate 12, are emitted out from of the cutter head 10 and are transmitted to the rock surface through air medium, so that the rock fully absorbs microwave energy to reach the rock splitting effect. Microwaves reflected back by the microwave focus radiator 6 enter the water load 13 through the third port of the circulator 5, and the reflected microwave energy is consumed through water circulation in the water load 13 so as to protect the safety of the circulator 5 and the microwave focus radiator 6.

The scheme in the embodiment is not intended to limit the patent protection scope of the present invention, and any equivalent implementation or change made without departing from the present invention shall be included in the scope of the patent of the scheme.

What is claimed is:

1. A cutter head for a microwave presplitting type hard-rock tunnel boring machine, wherein the cutter head defines an outer circumference near an outer periphery thereof and an inner circumference near an axis thereof, a diameter of the outer circumference is greater than that of the inner circumference, a plurality of microwave transmitting ports are formed in a front surface of the cutter head, a wave-transparent protection plate is mounted at external-end holes of the microwave transmitting ports, internal-end holes of the microwave transmitting ports communicate with the cutter head, a plurality of microwave generating mechanisms are arranged in the cutter head, and the microwave generating mechanisms are the same in number as the microwave transmitting ports and are in one-to-one correspondence; the microwave generating mechanisms are distributed in the cutter head in one of two distribution manners, wherein a first distribution manner is as follows: the microwave generating mechanisms are uniformly arranged in the cutter head; a second distribution manner is as follows: the microwave generating mechanisms are the same in number as hobbing cutters on the cutter head and are arranged in one-to-one correspondence, one microwave generating mechanism and the microwave transmitting port corresponding to the microwave generating mechanism are arranged beside each hobbing cutter; and when the microwave generating mechanisms are distributed in the cutter head in the first distribution manner, all the microwave generating mechanisms have the same microwave radiation power, and the number of the microwave generating mechanisms on the outer circumference and the inner circumference of the cutter head is calculated according to the following formula:

$$\frac{Q_R}{L_R} = \frac{Q_r}{L_r}$$

$$\frac{N_R PT}{\theta R} = \frac{N_r PT}{\theta r}$$

$$\frac{N_R}{N_r} = \frac{R}{r}$$

wherein $Q_R$ is a total microwave energy radiated by the microwave generating mechanisms on the outer circumference when the cutter head rotates by an angle of θ, $Q_r$ is a total microwave energy radiated by the microwave generating mechanisms on the inner circumference when the cutter head rotates by the angle of θ, $L_R$ is an arc length that the microwave generating mechanisms rotate on the outer circumference when the cutter head rotates by the angle of θ, $L_r$ is an arc length that the microwave generating mechanisms rotate on the inner circumference when the cutter head rotates by the angle of θ, P is a microwave radiation power of each of the microwave generating mechanisms, T is a microwave radiation time of each of the microwave generating mechanisms, R is a radius of the outer circumference of the cutter head, r is a radius of the inner circumference of the cutter head, $N_R$ is the number of the microwave generating mechanisms on the outer circumference of the cutter head, Nr is the number of the microwave generating mechanisms on the inner circumference of the cutter head, and θ is a rotation angle of the cutter head.

2. The cutter head for the microwave presplitting type hard-rock tunnel boring machine according to claim 1, wherein when the microwave generating mechanisms are distributed in the cutter head in the second distribution manner, all the microwave generating mechanisms have different microwave radiation power, total microwave energy radiated by the microwave generating mechanisms on the outer circumference of the cutter head is the same as that radiated by the microwave generating mechanisms on the inner circumference of the cutter head, and the microwave radiation power of the microwave generating mechanisms on the outer circumference and the inner circumference of the cutter head is calculated according to the following formula:

$$\frac{P_R T}{\theta_R} = \frac{P_r T}{\theta_r}$$

$$\frac{P_R}{P_r} = \frac{R}{r}$$

wherein $P_R$ is a total microwave radiation power of the microwave generating mechanisms on the outer circumference of the cutter head, $P_r$ is a total microwave radiation power of the microwave generating mechanisms on the inner circumference of the cutter head, T is a microwave radiation time of each of the microwave generating mechanisms, R is a radius of the outer circumference of the cutter head, r is a radius of the inner circumference of the cutter head, and θ is a rotation angle of the cutter head.

3. The cutter head for the microwave presplitting type hard-rock tunnel boring machine according to claim 1, wherein each microwave generating mechanism comprises a microwave source, a magnetron, a rectangular waveguide, a circulator and a microwave focus radiator, wherein the microwave source is connected with the magnetron, the magnetron is connected with one end of the rectangular waveguide, the other end of the rectangular waveguide is connected with a first port of the circulator, a second port of the circulator is connected with the microwave focus radiator, and a water load is connected to a third port of the circulator.

4. The cutter head for the microwave presplitting type hard-rock tunnel boring machine according to claim 3, wherein the microwave focus radiator comprises a standard waveguide section, an impedance matching section and a compressed radiation section, wherein the standard waveguide section is used for receiving microwaves emitted by the microwave source, the standard waveguide section is connected with the impedance matching section, and the impedance matching section is connected with the compressed radiation section; the impedance matching section is used for forming impedance matching between the standard waveguide section and the compressed radiation section; and the compressed radiation section is used for forming and radiating microwaves with high power density, and the compressed radiation section is embedded in the microwave transmitting port.

5. The cutter head for the microwave presplitting type hard-rock tunnel boring machine according to claim 4, wherein the standard waveguide section has a constant-section rectangular metal cavity, and a transverse broadside dimension of the constant-section rectangular metal cavity is matched with a wave length of microwaves emitted by the microwave source.

6. The cutter head for the microwave presplitting type hard-rock tunnel boring machine according to claim 4, wherein the impedance matching section has a variable-section rectangular metal cavity, and a transverse broadside dimension of the variable-section rectangular metal cavity is matched with a wave length of microwaves emitted by the microwave source; and a longitudinal narrow-side dimension of the variable-section rectangular metal cavity of the impedance matching section forms linear transition from large to small, a large-dimension end of the longitudinal narrow-side is connected with the standard waveguide section, and a small-dimension end of the longitudinal narrow-side is connected with the compressed radiation section.

7. The cutter head for the microwave presplitting type hard-rock tunnel boring machine according to claim 4, wherein the compressed radiation section has a constant-section rectangular metal cavity, and a transverse broadside dimension of the constant-section rectangular metal cavity is matched with a wave length of microwaves emitted by the microwave source.

8. The cutter head for the microwave presplitting type hard-rock tunnel boring machine according to claim 4, wherein the microwave source has a frequency of 2.45 GHz and a power of 10 kW or below, and a transverse broadside dimension of the rectangular waveguide, a transverse broadside dimension of the standard waveguide section, a transverse broadside dimension of the impedance matching section and a transverse broadside dimension of the compressed radiation section are 109 mm or 86 mm.

* * * * *